US011905643B2

(12) United States Patent
Hibdon et al.

(10) Patent No.: US 11,905,643 B2
(45) Date of Patent: Feb. 20, 2024

(54) FAULT DETECTION FOR A WATER LEVEL DETECTION SYSTEM OF A WASHING MACHINE APPLIANCE

(71) Applicant: Haier US Appliance Solutions, Inc., Wilmington, DE (US)

(72) Inventors: Charles Derek Hibdon, Louisville, KY (US); Darrin R. Smith, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/696,004

(22) Filed: Mar. 16, 2022

(65) Prior Publication Data

US 2023/0295861 A1 Sep. 21, 2023

(51) Int. Cl.

| | |
|---|---|
| ***D06F 39/08*** | (2006.01) |
| ***D06F 34/22*** | (2020.01) |
| *D06F 105/58* | (2020.01) |
| *D06F 103/18* | (2020.01) |
| *D06F 103/20* | (2020.01) |
| *D06F 103/24* | (2020.01) |

(52) U.S. Cl.

CPC ..... *D06F 39/087* (2013.01); *D06F 34/22* (2020.02); *D06F 39/082* (2013.01); *D06F 39/085* (2013.01); *D06F 2103/18* (2020.02); *D06F 2103/20* (2020.02); *D06F 2103/24* (2020.02); *D06F 2105/58* (2020.02)

(58) Field of Classification Search

CPC ..... D06F 33/47; D06F 33/62; D06F 33/74; D06F 34/16; D06F 39/082; D06F 39/087; D06F 2103/18; D06F 2103/24; D06F 2103/26; D06F 2105/58; D06F 2105/60

See application file for complete search history.

(56) References Cited

U.S. PATENT DOCUMENTS

| | | | | |
|---|---|---|---|---|
| 6,125,870 | A | 10/2000 | Furmanek | |
| 6,654,975 | B2 | 12/2003 | Broker | |
| 10,358,763 | B2 | 7/2019 | Pessot et al. | |
| 10,801,156 | B2 | 10/2020 | Pollett et al. | |
| 2014/0174547 | A1* | 6/2014 | Joo | A47L 15/0049 137/2 |
| 2021/0102332 | A1 | 10/2021 | Scheckelhoff et al. | |

FOREIGN PATENT DOCUMENTS

| | | | |
|---|---|---|---|
| CN | 109056270 | A | 12/2018 |
| EP | 2935676 | B1 | 7/2016 |
| KR | 200150324 | Y1 | 7/1999 |
| WO | WO2014097251 | A1 | 6/2014 |

* cited by examiner

*Primary Examiner* — David G Cormier

(74) *Attorney, Agent, or Firm* — Dority & Manning, P.A.

(57) ABSTRACT

A washing machine appliance is provided including a sump positioned at a bottom of a wash tub for collecting wash fluid, a drain pump assembly for selectively draining the sump, a measurement device configured for measuring movement of the wash tub, and a water level detection system comprising a pressure sensor fluidly coupled to the sump. A controller is configured to operate the drain pump assembly to drain the wash fluid, measure the movement of the wash tub using the measurement device, measure a water level within the sump using the water level detection system, and identify a fault condition in the water level detection system upon determining that the measured movement indicates that the sump is empty and the measured water level indicates that the sump is not empty.

20 Claims, 4 Drawing Sheets

FAULT DETECTION FOR A WATER LEVEL DETECTION SYSTEM OF A WASHING MACHINE APPLIANCE

FIELD OF THE INVENTION

The present subject matter relates generally to washing machine appliances, or more specifically, to fault detection methods for a water level detection system of a washing machine appliance.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Conventional washing machine appliances may include water level detection systems for detecting the amount of water dispensed into the tub during a fill cycle or the amount of water remaining within the sump after a drain cycle. For example, water level detection systems may include pressure sensors coupled to pressure hoses on the sump for detecting the water pressure for determining the water level. Such systems can use this information to detect fill or drainage issues, such as a drain pump failure, and to ensure the ideal amount of water is in the tub for performing a particular wash cycle. However, in certain situations, the pressure sensor may become partially blocked, bent, or may otherwise malfunction, resulting in erroneous pressure readings and/or a delayed response. Failure to address such issues or compensate for such variations in pressure readings can result in overfilling or underfilling the tub.

Accordingly, a washing machine appliance having improved water level detection systems would be desirable. More specifically, a water level detection system with fault detection would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a washing machine appliance is provided including a wash tub positioned within a cabinet and defining a wash chamber, a sump positioned at a bottom of the wash tub for collecting wash fluid, a drain pump assembly in fluid communication with the sump for selectively draining the wash fluid collected within the sump, a measurement device configured for measuring movement of the wash tub, a water level detection system comprising a pressure sensor fluidly coupled to the sump, and a controller operably coupled to the drain pump assembly, the measurement device, and the water level detection system. The controller is configured to operate the drain pump assembly to drain the wash fluid from the sump, measure the movement of the wash tub using the measurement device, measure a water level within the sump using the water level detection system, determine that the measured movement indicates that the sump is empty, determine that the measured water level indicates that the sump is not empty, and identify a fault condition in the water level detection system in response to determining that the measured movement indicates that the sump is empty and the measured water level indicates that the sump is not empty.

In another exemplary embodiment, a method for operating a washing machine appliance is provided. The washing machine appliance includes a sump positioned at a bottom of a wash tub for collecting wash fluid, a drain pump assembly in fluid communication with the sump for selectively draining the wash fluid collected within the sump, a measurement device configured for measuring movement of the wash tub, and a water level detection system comprising a pressure sensor fluidly coupled to the sump. The method includes operating the drain pump assembly to drain the wash fluid from the sump, measuring the movement of the wash tub using the measurement device, measuring a water level within the sump using the water level detection system, determining that the measured movement indicates that the sump is empty, determining that the measured water level indicates that the sump is not empty, and identifying a fault condition in the water level detection system in response to determining that the measured movement indicates that the sump is empty and the measured water level indicates that the sump is not empty.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
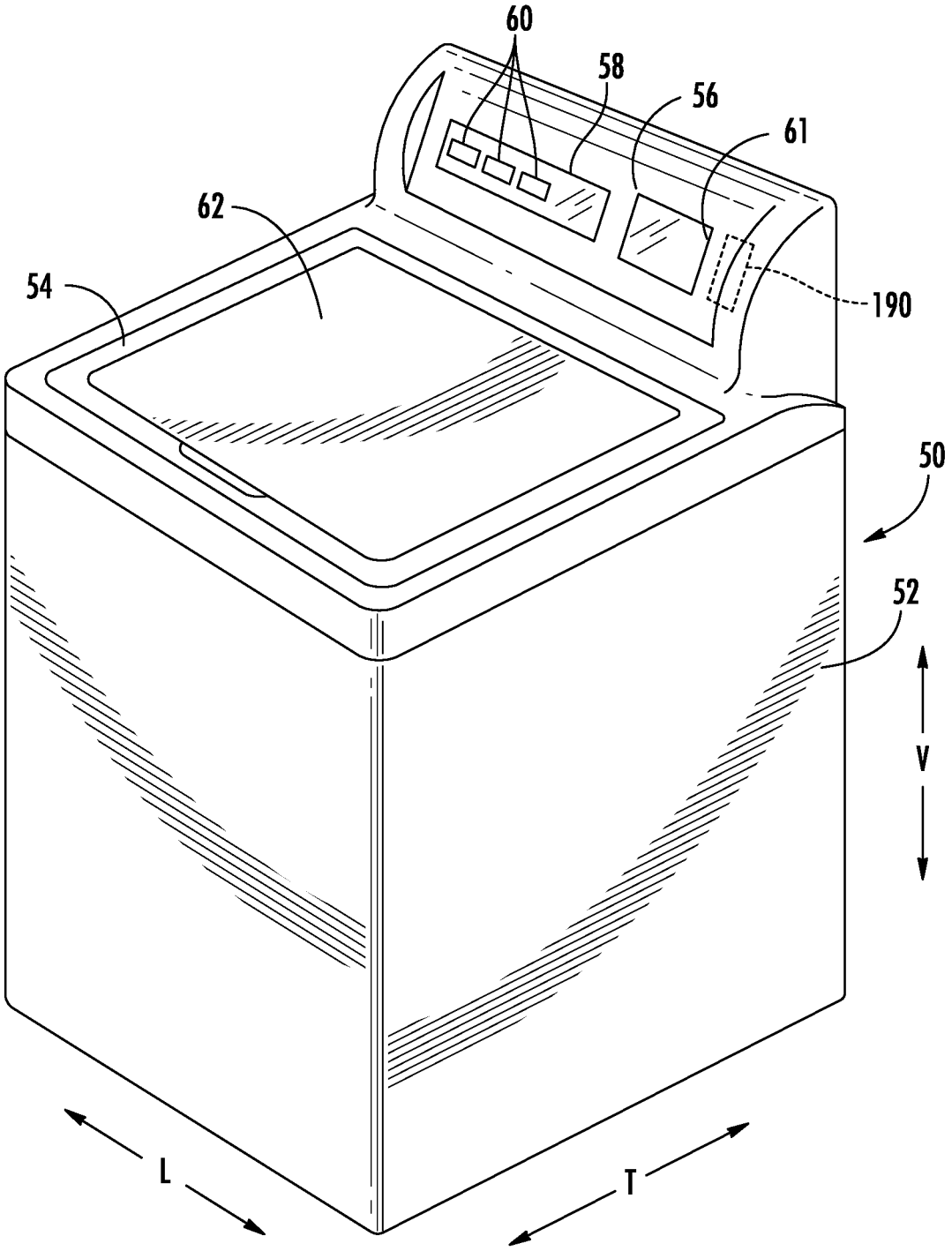
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
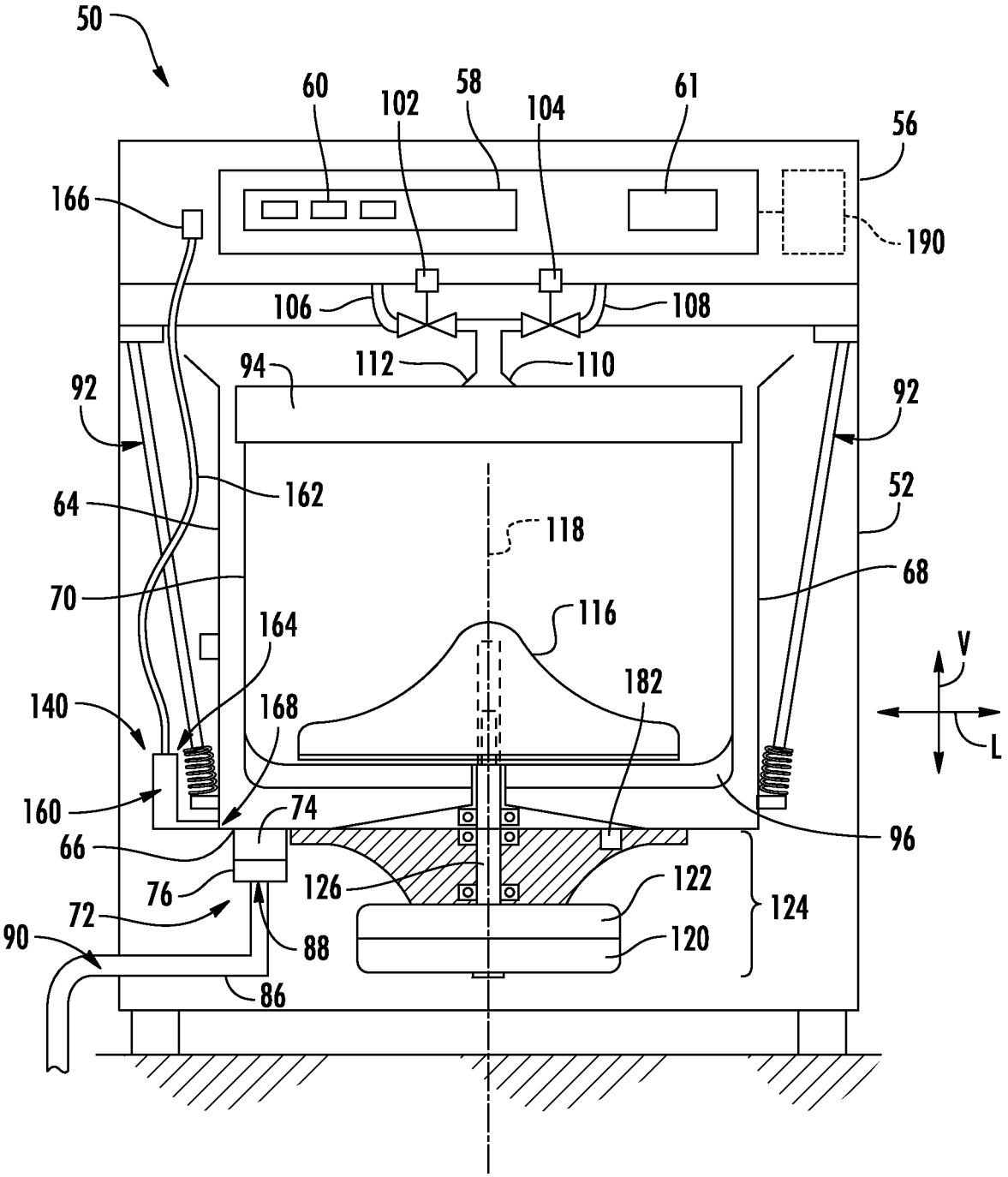
FIG. 2 provides a side cross-sectional view of the exemplary washing machine appliance of FIG. 1 including a drain pump assembly and a water level detection system according to an exemplary embodiment of the present subject matter.

Turning now to the figures, FIG. 1 provides a perspective view of a washing machine appliance 50 according to an exemplary embodiment of the present disclosure. FIG. 2 provides a front elevation schematic view of certain components of washing machine appliance 50.

As shown, washing machine appliance 50 includes a cabinet 52 and a cover 54. In some embodiments, a backsplash 56 extends from cover 54, and a control panel 58, including a plurality of input selectors 60, is coupled to backsplash 56. Control panel 58 and input selectors 60 collectively form a user interface input for operator selection of machine cycles and features, and in certain embodiments a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming an enclosure over tub 64.

As illustrated in FIGS. 1 and 2, washing machine appliance 50 is a vertical axis washing machine appliance. While the present disclosure is discussed with reference to an exemplary vertical axis washing machine appliance, those of ordinary skill in the art, using the disclosures provided herein, should understand that the subject matter of the present disclosure is equally applicable to other washing machine appliances or configurations.

Generally, tub 64 includes a bottom wall 66 and a sidewall 68 which collectively define a sump, e.g., a drain basin at the lowest point of wash tub 64 for collecting wash fluid under the force of gravity. Moreover, a basket 70 is rotatably mounted within tub 64. Generally, wash basket 70 is movably disposed and rotatably mounted in tub 64 in a spaced apart relationship from tub side wall 68 and tub bottom 66. Basket 70 includes a plurality of perforations therein to facilitate fluid communication between an interior of basket 70 and tub 64.

In some embodiments, a drain pump or pump assembly 72 is located beneath tub 64 and basket 70 for gravity assisted flow when draining tub 64. As would be understood, pump assembly 72 includes a pump 74 and a motor 76. In some embodiments, pump assembly 72, including motor 76, is mounted or attached to tub 64. For instance, pump assembly 72 may be fixed to tub 64 at bottom wall 66. A pump inlet hose or channel may extend from a tub outlet defined in tub bottom wall 66 to a pump inlet. A pump outlet hose 86 may extend from a pump outlet 88 to an appliance fluid outlet 90 and, ultimately to a building plumbing system discharge line (not shown) in fluid communication with outlet 90.

According to an exemplary embodiment, drain pump 74 is a positive displacement pump configured for urging wash fluid that collects in the sump and pump outlet hose 86 through a fluid outlet 90 and to an external drain. However, it should be appreciated that the drain pump assembly 72 and the sump drainage configuration illustrated herein are only exemplary and not intended to limit the scope of the present subject matter. For example, drain pump 74 may have a different configuration or position, may include one or more filtering mechanisms, etc.

In some embodiments, a hot liquid valve 102 and a cold liquid valve 104 deliver liquid, such as water, to basket 70 and tub 64 through a respective hot liquid hose 106 and cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and liquid is dispersed from inlet tube 110 through a nozzle assembly 112 having a number of openings therein to direct washing liquid into basket 70 at a given trajectory and velocity. A dispenser (not shown), may also be provided to produce a liquid or wash solution by mixing fresh water with a known detergent or other additive for cleansing of articles in basket 70.

In some embodiments, an agitation element 116, such as a vane agitator, impeller, auger, or oscillatory basket mechanism (or some combination thereof) is disposed in basket 70 to impart an oscillatory motion to articles and liquid in basket 70. In various exemplary embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated, agitation element 116 is oriented to rotate about a vertical axis 118.

Basket 70 and agitation element 116 are driven by a motor 120 through a transmission and clutch system 122. The motor 120 drives shaft 126 to rotate basket 70 within tub 64. Clutch system 122 facilitates driving engagement of basket 70 and agitation element 116 for rotatable movement within tub 64, and clutch system 122 facilitates relative rotation of basket 70 and agitation element 116 for selected portions of wash cycles. Motor 120 and transmission and clutch system 122 collectively are referred herein as a motor assembly 124.

Referring now to FIG. 2, basket 70, tub 64, pump assembly 72, and motor assembly 124 are supported by a vibration dampening suspension system. The dampening suspension system can include one or more suspension assemblies 92 coupled between and to the cabinet 52 and tub 64. Typically, four suspension assemblies 92 are utilized, and are spaced apart about the tub 64. For example, each suspension assembly 92 may be connected at one end proximate a corner of the cabinet 52 and at an opposite end to the tub 64. The washer can include other vibration dampening elements, such as a balance ring 94 disposed around the upper circumferential surface of the wash basket 70. The balance ring 94 can be used to counterbalance an out of balance condition for the wash machine as the basket 70 rotates within the tub 64. The wash basket 70 could also include a balance ring 96 located at a lower circumferential surface of the wash basket 70.

Operation of washing machine appliance 50 is controlled by a controller 190 that is operatively coupled (e.g., electrically coupled or connected) to a user interface (e.g., user interface 58) located on washing machine backsplash 56 (FIG. 1) for user manipulation to select washing machine cycles and features. In response to user manipulation of the user interface (e.g., inputs thereof), controller 190 operates the various components of washing machine appliance 50 to execute selected machine cycles and features.

Controller 190 may include a memory (e.g., non-transitory storage media) and microprocessor, such as a general or special purpose microprocessor operable to execute programming instructions or micro-control code associated with a washing operation or cycle. The memory may represent random access memory such as DRAM, or read only memory such as ROM or FLASH. In one embodiment, the processor executes programming instructions stored in memory (e.g., as software). The memory may be a separate component from the processor or may be included onboard within the processor. Alternatively, controller 190 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 58 and other components of washing machine appliance 50, such as motor assembly 124 and other measurement devices (discussed herein) may be in communication with controller 190 via one or more signal lines, shared communication busses, or wireless networks to provide signals to or receive signals from the controller 190.

In an illustrative embodiment, laundry items or articles are loaded into basket 70, and a washing operation is initiated through operator manipulation of control input selectors 60 (shown in FIG. 1). Tub 64 is filled with liquid, such as water, and mixed with detergent to form a wash fluid. Basket 70 is agitated with agitation element 116 (e.g., as part of an agitation phase of a wash cycle) for cleansing of laundry items in basket 70. That is, agitation element 116 is moved back and forth in an oscillatory back and forth motion about vertical axis 118, while basket 70 remains generally stationary (i.e., not actively rotated). In the illustrated embodiment, agitation element 116 is rotated clockwise a specified amount about the vertical axis 118 of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism. After the agitation phase of the wash cycle is completed, tub 64 is drained with pump assembly 72 (e.g., as part of a drain phase). Laundry articles can then be rinsed by again adding liquid to tub 64. Depending on the particulars of the cleaning cycle selected by a user, agitation element 116 may again provide agitation within basket 70. After a rinse cycle, tub 64 is again drained, such as through use of pump assembly 72 (e.g., as part of another drain phase). After liquid is drained from tub 64, one or more spin cycles may be performed. In particular, a spin cycle may be applied after the agitation phase or after the rinse phase in order to wring excess wash fluid from the articles being washed, as will be further described below. During a spin cycle, basket 70 is rotated at one or more relatively high speeds about vertical axis 118, such as between approximately 450 and approximately 1300 revolutions per minute.

While described in the context of a specific embodiment of vertical axis washing machine appliance 50, using the teachings disclosed herein it will be understood that vertical axis washing machine appliance 50 is provided by way of example only. Other washing machine appliances having different configurations, different appearances, and/or different features may also be utilized with the present subject matter as well, e.g., horizontal axis washing machine appliances.

Referring now to FIG. 2, a water level detection system 140 that may be used within washing machine appliance 50 will be described according to an exemplary embodiment. Specifically, FIG. 2 provides a front view of water level detection system 140 operably coupled to a drain pump assembly (e.g., drain pump assembly 72). However, water level detection system 140 as described herein is only one exemplary configuration used for the purpose of explaining aspects of the present subject matter and is not intended to limit the scope of the invention in any manner.

Water level detection system 140 may generally include an air chamber 160 that extends from wash tub 164, the sump, or any suitable location within pump assembly 72. Air chamber 160 extends at least partially upward along the vertical direction V and a pressure hose 162 is fluidly coupled to a top end 164 of air chamber 160 and extends to a pressure sensor 166. In general, pressure sensor 166 may be any sensor suitable for determining a water level within wash tub 64 based on pressure readings. For example, pressure sensor 166 may be a piezoelectric pressure sensor and thus may include an elastically deformable plate and a piezoresistor mounted on the elastically deformable plate. According to exemplary embodiments, pressure sensor 166 is positioned proximate a top of cabinet 52, e.g., proximate or mounted to control panel 58. Thus, pressure hose 162 extends from air chamber 160 (i.e., proximate a bottom of cabinet 52) upward along the vertical direction V to pressure sensor 166.

Water level detection system 140 and pressure sensor 166 generally operate by measuring a pressure of air within air chamber 160 and using the measured chamber pressure to estimate the water level in the sump or wash tub 64. For example, when the water level falls below a chamber inlet 168, the pressure within air chamber 160 normalizes to ambient or atmospheric pressure, and thus reads a zero pressure. However, when water is present in the sump or wash tub 64 and rises above chamber inlet 168, the measured air pressure becomes positive and may increase proportionally with the water level. Although wash tub 64 is described herein as containing water, it should be appreciated that aspects of the present subject matter may be used for detecting the level of any other suitable wash fluid.

As noted above, water level detection system 140 may experience faults, errors, or inaccuracies during operation that result in incorrect pressure readings, water volumes or fluid levels within wash tub 64, and/or general wash performance degradation. Aspects of the present subject matter are directed to identifying such fault conditions and implementing corrective action or notifying a user. For example, water level detection system 140, or more specifically pressure sensor 166, may generate incorrect pressure readings when pressure hose 162 is clogged, bent, partially blocked, or otherwise obstructed during operation. It may be desirable to detect such a condition.

Accordingly, aspects of the present subject matter may generally be directed to detecting a faulty water level detection system 140. For example, referring again to FIG. 2, washing machine appliance 50 may further include a measurement device 182 that is mounted to wash tub 64 and is generally configured for measuring movement of wash tub 64. For example, measurement device 182 may be generally configured to measure movement during at least a portion of a washing operation, such as during a drain cycle when drain pump assembly 72 is active or when wash basket 70 rotates. As will be described in greater detail below, wash tub movement may be used to verify or cross-check the accuracy of the water level detection system 140 or for detecting fault conditions associated with the water level detection system 140.

A measurement device 182 in accordance with the present disclosure may include an accelerometer which measures translational motion, such as acceleration along one or more directions. Additionally or alternatively, a measurement device 182 may include a gyroscope, which measures rotational motion, such as rotational velocity about an axis. A measurement device 182 in accordance with the present disclosure is mounted to the wash tub 64 (e.g., on bottom wall 66) to sense movement of the wash tub 64 relative to the cabinet 52 by measuring uniform periodic motion, non-uniform periodic motion, or excursions of the wash tub 64 during appliance operation.

Accordingly to an exemplary embodiment, a measurement device 182 may be or include an accelerometer, which measures translational motion (e.g., as an acceleration component), such as acceleration along one or more directions. Additionally or alternatively, a measurement device 182 may be or include a gyroscope, which measures rotational motion (e.g., as a rotation component), such as rotational velocity about a predetermined axis. Additionally or alternatively, a measurement device 182 may be or include an optical sensor, an inductive sensor, a Hall Effect sensor, a potentiometer, a load cell, a strain gauge, or any other suitable device capable of measuring, either directly or indirectly, translational or rotational movement of wash tub 64. A measurement device 182 in accordance with the present disclosure can be mounted to the wash tub 64 (e.g., on bottom wall 66), the wash basket 70, or the cabinet 52, as required to sense movement of the wash tub 64 relative to the cabinet 52. In particular exemplary embodiments, such as when accelerometers or gyroscopes are utilized, the accelerometers or gyroscopes may be mounted to the wash tub 64.

In exemplary embodiments, a measurement device 182 may include at least one gyroscope or at least one accelerometer. The measurement device 182, for example, may be a printed circuit board which includes the gyroscope and accelerometer thereon. The measurement device 182 may be mounted to the wash tub 64 (e.g., via a suitable mechanical fastener, adhesive, etc.) and may be oriented such that the various sub-components (e.g., the gyroscope and accelerometer) are oriented to measure movement along or about particular directions as discussed herein.

Notably, the gyroscope and accelerometer in exemplary embodiments are advantageously mounted to the wash tub 64 at a single location (e.g., the location of the printed circuit board or other component of the measurement device 182 on which the gyroscope and accelerometer are grouped). Such positioning at a single location advantageously reduces the costs and complexity (e.g., due to additional wiring, etc.) of detecting or measuring movements to the wash tub 64 caused by the pump assembly 72, while still providing relatively accurate movement detection as discussed herein. Alternatively, however, the gyroscope and accelerometer need not be mounted at a single location. For example, a gyroscope located at one location on wash tub 64 can measure the rotation of a gyroscope located at a different location on wash tub 64, because rotation about a given axis is the same everywhere on a solid object such as wash tub 64.

In general, measurement device may be used to measure movement as one or more rotation or acceleration components (see FIGS. 4 and 5), detected at the one or more measurement devices 182. Measurement devices 182 may measure a variety of suitable variables, which can be correlated to movement of the wash tub 64. The movement measured by such devices 182 can be utilized to monitor the operation or state of the pump assembly 72, in particular during a drain cycle, and to advantageously provide a secondary indication of the amount of wash fluid within wash tub 64.

As illustrated in FIG. 2, wash tub 64 may define axis of rotation which may extend substantially along the vertical direction V when wash tub 64 and wash basket 70 are balanced. Movement of the wash tub 64 measured by measurement devices 182 (such as a rotation component or acceleration component of such movement) may, in exemplary embodiments, be an indirect or direct measurement of rotation or oscillation of wash tub 64 (e.g., about the axis of rotation).

Now that the construction of washing machine appliance 50 and the configuration of controller 190 according to exemplary embodiments have been presented, an exemplary method 200 of operating a washing machine appliance will be described. Although the discussion below refers to the exemplary method 200 of operating washing machine appliance 50, one skilled in the art will appreciate that the exemplary method 200 is applicable to the operation of a variety of other washing machine appliances, such as horizontal axis washing machine appliances. In exemplary embodiments, the various method steps as disclosed herein may be performed by controller 190 or a separate, dedicated controller.

Figure 3:
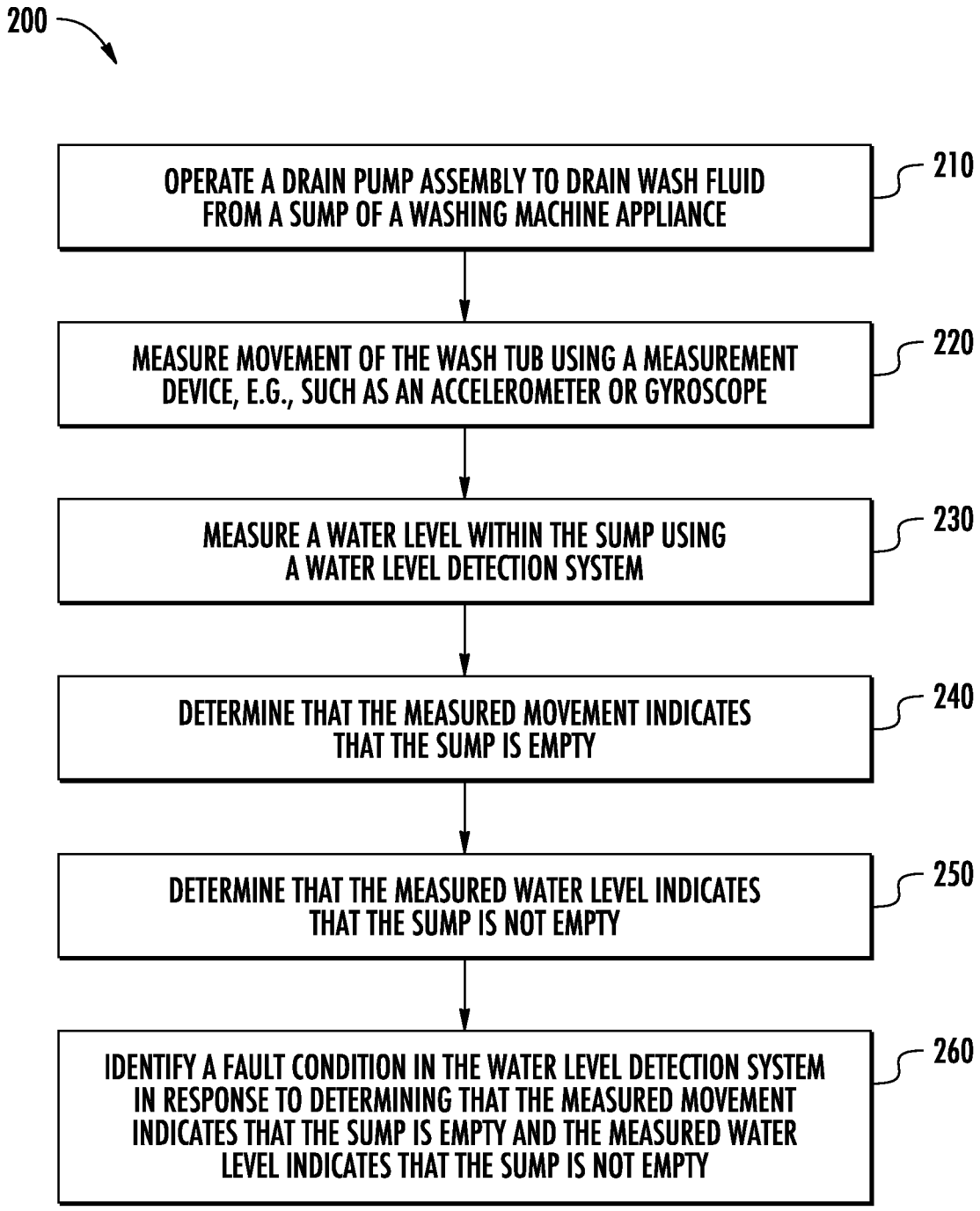
FIG. 3 illustrates a method for detecting a fault in a water level detection system of a washing machine appliance in accordance with one embodiment of the present disclosure.

Referring now to FIG. 3, method 200 includes, at step 210, operating a drain pump assembly to drain wash fluid from a sump of a washing machine appliance. For example, continuing the example from above, drain pump assembly 72 may be energized during a drain cycle of washing machine appliance 50 to pump wash fluid out of the sump or wash tub 64, through pump outlet hose 86, and out through an external drain. As mentioned above, the operation of drain pump assembly 72 generates vibrations or movement of wash tub 64, e.g., as illustrated for example in FIGS. 4 and 5. Aspects of the present subject matter are directed to methods for using these movements or vibrations to estimate or detect a water level within the sump or wash tub 64, e.g., for verifying the accuracy of water level detection system 140.

Accordingly, step 220 generally includes measuring movement of the wash tub using a measurement device. For example, measurement device 182 may monitor the movement of wash tub 64. It should be appreciated that the measurement device may be any suitable device, such as an accelerometer for measuring translational movement, a gyroscope for measuring rotational movement, or some combination therebetween. According to exemplary embodiments, the output of step 220 may include movement profiles as illustrated in FIGS. 4 and 5.

Figure 4:
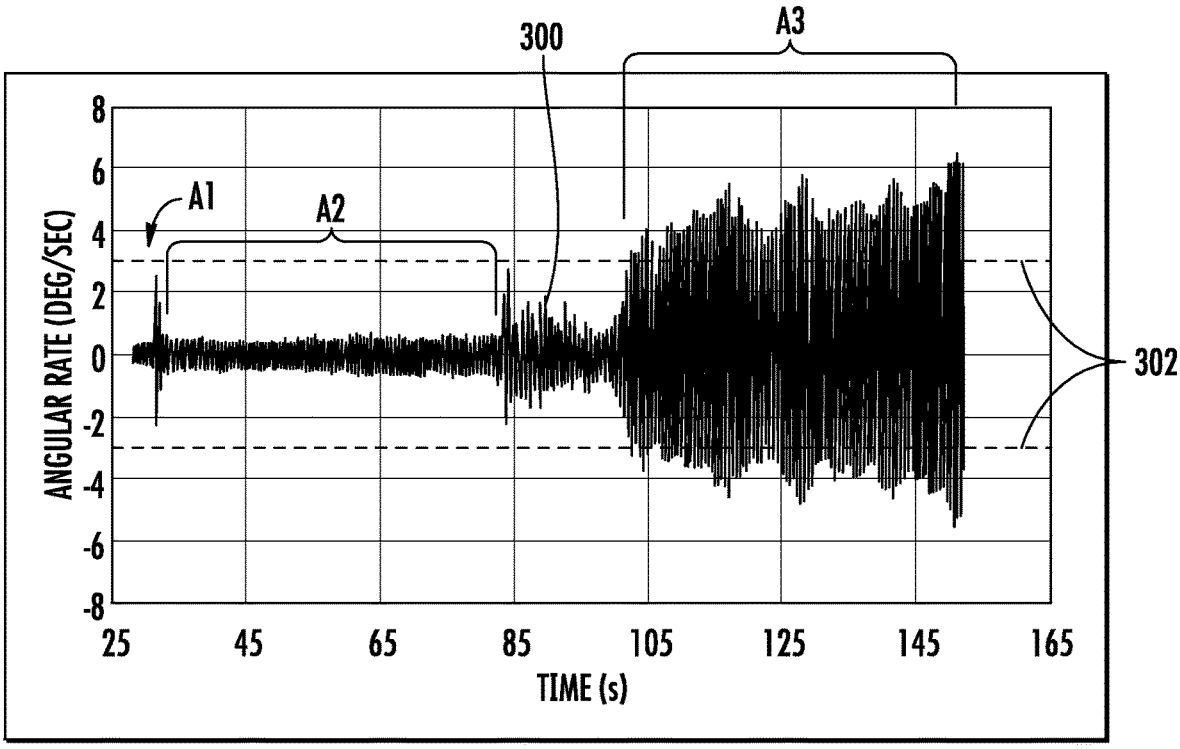
FIG. 4 provides a graph illustrating a measured angular movement rate relative to time across a drain cycle for a wash tub of an exemplary washing machine appliance of the present disclosure.
Figure 5:
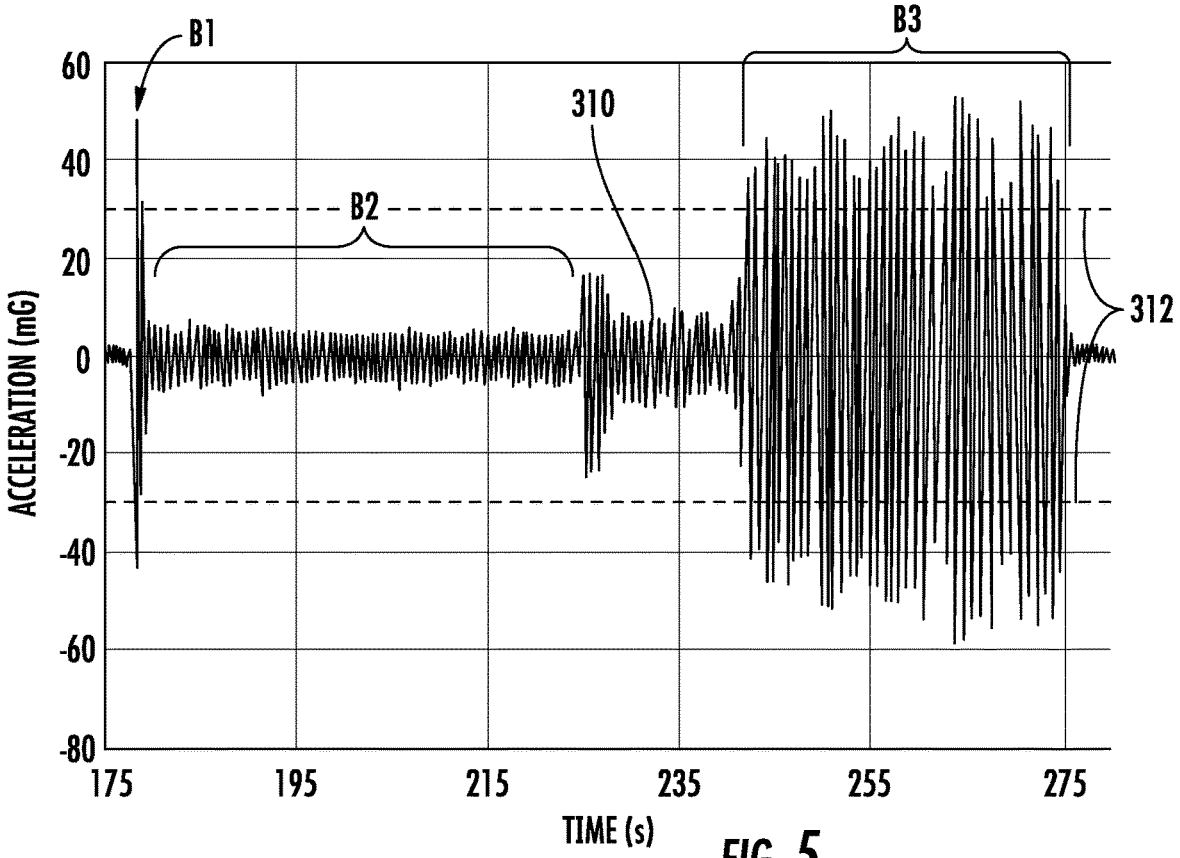
FIG. 5 provides a graph illustrating a measured acceleration relative to time across a drain cycle for a wash tub of an exemplary washing machine appliance of the present disclosure.

For example, turning now specifically to FIGS. 4 and 5, multiple measurements recorded during a drain cycle of an exemplary washing machine appliance are illustrated. In particular, FIG. 4 illustrates a recorded rotation component of the measured movement (e.g., in degrees of rotation over time) relative to a period of time (e.g., in seconds). Thus, the measured movement of the wash tub 64 may include a rotation component (e.g., detected at the gyroscope of measurement device 182) of wash tub 64 about the axis of rotation A. In optional embodiments, the raw data detected at the measurement device 182 may be selectively filtered (e.g., to reduce noise or interference received at the measurement device 182). For example, one or more dominant frequencies attributable to the pump assembly 72 may be identified or determined in advance from testing results of prototype model. In some instances, the dominant frequency or frequencies may be detectable by a relatively high power frequency ratio (e.g., dB/Hz) at one or more specific frequencies detected at, for instance, the gyroscope of the measurement device 182. During certain washing operations, a bandpass filter may be applied to the frequencies or signals detected at the measurement device 182, thereby restricting measured movement to the dominant frequency or frequencies. As would be understood, the measured movement, including values thereof, may be recorded over time (e.g., at controller 190).

As generally illustrated in FIG. 4, various portions or characteristics of a washing operation (e.g., during a drain phase of a wash cycle) of a washing machine appliance 50 may be detected or identified according to a rotation component (e.g., angular rate in degrees per second) over time (e.g., in seconds). For instance, a sudden initial spike or increase in the angular rate (e.g., A1) may indicate that the pump assembly has been activated (e.g., to pump water or wash fluid from wash tub 64). A subsequent time span or period of relatively low angular rates (e.g., A2) may indicate that the pump assembly is actively motivating water or wash fluid from wash tub 64. A further subsequent time span or period of relatively high angular rates (e.g., A3) may indicate that the pump assembly 72 is running dry. In other words, an increase in the magnitude of oscillations of the angular rate may be indicative of an empty sump.

Turning to FIG. 5, multiple measurements recorded during a drain cycle of an exemplary wash operation is illustrated. In particular, FIG. 5 illustrates a recorded acceleration component of the measured movement (e.g., in millig-units, or mG) relative to a period of time (e.g., in seconds). Thus, the measured movement of the wash tub 64 may include an acceleration component (e.g., detected at the accelerometer of measurement device 182) of wash tub 64 perpendicular to the axis of rotation A. As would be understood, the measured movement, including values thereof, may be recorded over time (e.g., at controller 190).

As generally illustrated in FIG. 5, various portions or characteristics of a washing operation (e.g., during a drain phase of a wash cycle) may be detected or identified according to an acceleration component (e.g., acceleration in mG) over time (e.g., in seconds). For instance, a sudden initial spike or increase in the acceleration (e.g., B1) may indicate the pump assembly has been activated (e.g., to pump water or wash fluid from the tub). A subsequent time span or period of relatively low acceleration (e.g., B2) may indicate that the pump assembly is actively motivating water or wash fluid from the tub. A further subsequent time span or period of relatively high acceleration (e.g., B3) may indicate that the pump assembly is running dry. In other words, an increase in the magnitude of oscillations of the acceleration may be indicative of an empty sump.

Step 230 includes measuring a water level within the sump using a water level detection system. In this regard, continuing the example from above, water level detection system 140 may be used to monitor a volume, weight, and/or height of wash fluid within the sump or wash tub 64. For example, pressure sensor 166 may be used to monitor sump pressures throughout the fill cycle, the operating cycle, and/or the drain cycle of washing machine appliance 50. These sump pressures may be measured periodically or continuously at any suitable frequency and for any suitable duration.

Step 240 may generally include determining that the measured movement indicates that the sump is empty. In this regard, method 200 may include analyzing or observing the movement of the wash tub, e.g., as measured by measurement device 182 and/or displayed in FIGS. 4 and 5 to determine that the sump is empty. It should be appreciated that various mathematical methods or statistical analysis may be performed to determine when the measured movement should be deemed as indicating an empty sump. Although exemplary methods for making such determination are provided herein, e.g., using the plots illustrated in FIGS. 4 and 5, it should be appreciated that these methods may vary while remaining within the scope of the present subject matter.

For example, according to an exemplary embodiment, determining that the measured movement indicates that the sump is empty may include determining that the measured movement exceeds a movement threshold. This movement threshold may be defined in any suitable manner. For example, the measured movement may be represented as a peak angular rate of oscillation. In addition, the predetermined movement threshold may be programmed by the user, set by the manufacturer, or determined in any other suitable manner. If the peak angular rate oscillation exceeds this movement threshold, step 240 may result in a determination that the sump is empty. According to alternative embodiments, in order to avoid a false indication of an empty sump, e.g., in the event that something bumps the appliance or an item shifts within wash basket 70, step 240 may include a procedure which requires that the peak angular rate exceeds the movement threshold for a predetermined amount of time or over predetermined number of oscillations.

For example, referring now briefly to FIG. 4, the angular rate of rotation of wash tub 64 as measured by measurement device 182, or more specifically the gyroscope, may be identified generally by reference numeral 300. In addition, as illustrated, an angular rate of rotation threshold may be identified generally by reference line 302. According to exemplary embodiments, rotation threshold 302 may be between about 1 and 6 degrees per second, between about 2 and 5 degrees per second, or about 3 degrees per second (as illustrated). Accordingly, when the oscillation amplitude of measured rotation 300 exceeds the rotation threshold 302, e.g., as identified generally by period A3, this may be indicative of an empty sump.

Similarly, referring now briefly to FIG. 5, the acceleration of wash tub 64 as measured by measurement device 182, or more specifically the accelerometer, may be identified generally by reference numeral 310. In addition, as illustrated, an acceleration threshold may be identified generally by reference line 312. According to exemplary embodiments, acceleration threshold 312 may be between about 10 and 50 millig-units, between about 20 and 40 millig-units, or about 30 millig-units (as illustrated). Accordingly, when the oscillation amplitude of measured acceleration 310 exceeds the acceleration threshold 312, e.g., as identified generally by period B3, this may be indicative of an empty sump.

It should be appreciated that step 240 may include additional steps and processes for mathematically determining when the measured rotation or acceleration exceeds a predetermined threshold. For example, according to an exemplary embodiment, determining that the measured movement indicates that the sump is empty may include calculating a moving average of the measured movement and determining that the moving average exceeds a moving average threshold. In addition, or alternatively, determining that the measured movement indicates that the sump is empty may include calculating a slope of the moving average and determining that the slope of the moving average exceeds a slope threshold.

In addition, method 200 may include, at step 250, determining that the measured water level indicates that the sump is not empty. Notably, as explained above with respect to step 240, the measured movement indicates that the sump is empty, such that there is a discrepancy between the estimated water level determined from the measurement device 182 versus the water level detection system 140. Step 260 may include identifying a fault condition in the water level detection system in response to identifying this discrepancy.

Method 200 may further include a variety of responsive actions upon identifying the fault condition the water level detection system. For example, method 200 may include performing additional drain cycles or implementing additional drain time to ensure that all water is removed from sump. In addition, or alternatively, controller 190 may lock down or prevent further operation of washing machine appliance 50, may schedule a service visit, may provide a user notification as to the fault condition of the water level detection system (e.g., via display 61 or a remote device such as a mobile phone), etc. Other responsive actions are possible and within the scope of the present subject matter.

FIG. 3 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using washing machine appliance 50 as an example, it should be appreciated that these methods may be applied to the operation of any suitable washing machine appliance.

As explained above, aspects of the present subject matter are directed to a method of detecting a clogged, bent, obstructed, or partially blocked pressure sensor tube or system in a washing machine. In this regard, washing machine appliance (e.g., particularly top load washers) have a failure mode where the pressure sensor system is fully or partially clogged, is kinked trapping air in the pressure tube, or is otherwise malfunctioning. The pressure detection system may consist of a tub which contains water, a pressure chamber and a port on outside of the tub, a pressure tube, a pressure sensing device, and an electronic control. This system may monitor only pressure to determine various failures in the pressure and drain systems and its components. Notably, however, this system may not be able to differentiate between failed drain pump and a clogged pressure sensor using only pressure measurements.

Accordingly, aspects of the present subject matter are directed to a method for detecting clogged, bent, obstructed, or partially blocked pressure sensor tube or system in the washing machine using an existing an accelerometer/gyroscope mounted on the tub. In this regard, the accelerometer/gyroscope signal may be used to determine if the washer tub is empty or not. For example, when the washer drain pump is pumping water, the accelerometer/gyroscope signal may be different than when the washer tub is emptied and it is pumping dry. Notably, when the accelerometer/gyroscope indicates that the tub is empty, the pressure sensor should indicate that the water level is below an empty level.

The empty tub determination may be made independent of the pressure sensor signal. If pressure sensor detects pressure above the "empty" pressure when accelerometer/gyroscope detects empty, then the pressure sensor tube is likely clogged or partially blocked. Thus, an accelerometer/gyroscope sensor signal that indicates an empty sump may be paired with a conflicting pressure sensor signal which indicates presence of water in washer tub, thereby detecting a clogged pressure sensor. This can then be paired with an existing drain fault logic which uses pressure sensor to create a new unique fault that more accurately points to failure in the pressure sensor tube system. Logic/mathematical methods can be used to categorize the accelerometer/gyroscope signal as either "empty" or "not empty" by taking a moving average of the signal and comparing to a defined limit or by monitoring the slope of the current signal and comparing to a defined limit.

The method allows for further narrowing down of failure modes of the pressure and drain systems, thereby assisting technicians in quick root-cause of system failures in the field. In addition, this method enables technicians to be prepared with the right parts for servicing units by using diagnostics data available prior to technician running a service call in consumer's home. Also, this information may be used to notify technicians for service of the suspect pressure tube/drain systems.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a wash tub positioned within a cabinet and defining a wash chamber;

a sump positioned at a bottom of the wash tub for collecting wash fluid;

a drain pump assembly in fluid communication with the sump for selectively draining the wash fluid collected within the sump;

a measurement device configured for measuring movement of the wash tub;

a water level detection system comprising a pressure sensor fluidly coupled to the sump; and a controller operably coupled to the drain pump assembly, the measurement device, and the water level detection system, the controller being configured to:

operate the drain pump assembly to drain the wash fluid from the sump;

measure the movement of the wash tub using the measurement device;

measure a water level within the sump using the water level detection system;

determine that the measured movement indicates that the sump is empty;

determine that the measured water level indicates that the sump is not empty; and identify a fault condition in the water level detection system in response to determining that the measured movement indicates that the sump is empty and the measured water level indicates that the sump is not empty.

2. The washing machine appliance of claim 1, wherein determining that the measured movement indicates that the sump is empty comprises:

determining the measured movement exceeds a movement threshold.

3. The washing machine appliance of claim 2, wherein the measurement device is an accelerometer mounted to the wash tub and the measured movement is translational motion of the wash tub.

4. The washing machine appliance of claim 3, wherein the movement threshold is between about 10 and 40 millig-units.

5. The washing machine appliance of claim 3, wherein the movement threshold is 20 millig-units.

6. The washing machine appliance of claim 2, wherein the measurement device is a gyroscope mounted to the wash tub and the measured movement is rotational motion.

7. The washing machine appliance of claim 6, wherein the movement threshold is between about 1 and 6 degrees per second.

8. The washing machine appliance of claim 6, wherein the movement threshold is 2 degrees per second.

9. The washing machine appliance of claim 2, wherein the movement threshold is empirically determined to correspond to an empty sump.

10. The washing machine appliance of claim 1, wherein determining that the measured movement indicates that the sump is empty comprises:

calculating a moving average of the measured movement; and determining that the moving average exceeds a moving average threshold.

11. The washing machine appliance of claim 10, wherein determining that the measured movement indicates that the sump is empty comprises:

calculating a slope of the moving average; and determining that the slope of the moving average exceeds a slope threshold.

12. The washing machine appliance of claim 10, wherein the controller is further configured to:

provide a user notification of the fault condition.

13. A method for operating a washing machine appliance, the washing machine appliance comprising a sump positioned at a bottom of a wash tub for collecting wash fluid, a drain pump assembly in fluid communication with the sump for selectively draining the wash fluid collected within the sump, a measurement device configured for measuring movement of the wash tub, and a water level detection system comprising a pressure sensor fluidly coupled to the sump, the method comprising:

operating the drain pump assembly to drain the wash fluid from the sump;

measuring the movement of the wash tub using the measurement device;

measuring a water level within the sump using the water level detection system;

determining that the measured movement indicates that the sump is empty;

determining that the measured water level indicates that the sump is not empty; and identifying a fault condition in the water level detection system in response to determining that the measured movement indicates that the sump is empty and the measured water level indicates that the sump is not empty.

14. The method of claim 13, wherein determining that the measured movement indicates that the sump is empty comprises:

determining the measured movement exceeds a movement threshold.

15. The method of claim 14, wherein the measurement device is an accelerometer mounted to the wash tub and the measured movement is translational motion of the wash tub.

16. The method of claim 15, wherein the movement threshold is between about 10 and 40 millig-units.

17. The method of claim 14, wherein the measurement device is a gyroscope mounted to the wash tub and the measured movement is rotational motion.

18. The method of claim 17, wherein the movement threshold is between about 1 and 6 degrees per second.

19. The method of claim 14, wherein the movement threshold is empirically determined to correspond to an empty sump.

20. The method of claim 13, wherein determining that the measured movement indicates that the sump is empty comprises:

calculating a moving average of the measured movement; and determining that the moving average exceeds a moving average threshold.

* * * * *